United States Patent [19]

Heiman

[11] 4,416,365

[45] Nov. 22, 1983

[54] COIN EXAMINATION APPARATUS EMPLOYING AN RL RELAXATION OSCILLATOR

[75] Inventor: Frederic P. Heiman, Philadelphia, Pa.

[73] Assignee: Mars, Inc., McLean, Va.

[21] Appl. No.: 295,139

[22] Filed: Aug. 21, 1981

[51] Int. Cl.[3] ..... G07D 5/08

[52] U.S. Cl. ..... 194/100 A; 331/151

[58] Field of Search ..... 194/100 A, 100 R; 133/1 K, 1 R, 1 A, 3, 8 R, 8 A, 8 B, 8 C, 8 D; 324/51, 207, 225, 322, 327, 236; 331/141, 111, 143, 151; 336/75; 340/686, 870.35

[56] References Cited

U.S. PATENT DOCUMENTS 4,284,961 8/1981 Landau ..... 331/111

FOREIGN PATENT DOCUMENTS 673650 6/1952 United Kingdom ..... 331/151

1575365 9/1980 United Kingdom .

*Primary Examiner*—Stanley H. Tollberg

*Attorney, Agent, or Firm*—Davis, Hoxie, Faithfull & Hapgood

[57] ABSTRACT

An apparatus for coin testing including an improved inductive sensing arrangement. A coin to be tested is passed through an electromagnetic field produced by an inductor which is part of a resistor-inductor type relaxation oscillator operating at a frequency in the range of approximately 100 kHz to 1 MHz. The resulting shift in frequency of the relaxation oscillator forms the basis for testing the coin. The resistor-inductor relaxation oscillator has a linear frequency response with respect to changes in the effective inductance in the oscillator over a range of inductance suitable for testing coins and produces an output signal which is digital in nature and requires no amplitude discrimination or shaping to be suitable for counting.

9 Claims, 6 Drawing Figures

COIN EXAMINATION APPARATUS EMPLOYING AN RL RELAXATION OSCILLATOR

FIELD OF THE INVENTION

This invention relates to an apparatus for coin testing and more particularly to an improved inductive sensing arrangement for use in electronic coin testing apparatus.

BACKGROUND OF THE INVENTION

There are several types of inductive coin discrimination apparatus based upon passing a coin through the electromagnetic field of an inductor which is part of an oscillator circuit. For greater accuracy of discrimination, a coin may be examined using two or more frequencies by introducing the coin into electromagnetic fields of different frequencies and determining if the interactions betwen the coin being tested and the fields are within predetermined tolerances anticipated for acceptable electrically conductive coins. See, for example, U.S. Pat. No. 3,870,137, assigned to the assignee of the present application.

In some of the tests by apparatus as disclosed in the prior art, the coin under test is introduced through a coin entry and travels along a coin passageway past an inductor or inductors located along one side of the coin passageway or in some cases on opposing sides of the coin passageway. The inductor is part of an inductor-capacitor (LC) oscillator circuit which oscillates at an idling frequency in the absence of a coin. When a coin is present alongside the inductor, the frequency of the oscillator circuit containing the inductor shifts. The degree of interaction between the coin and the electromagnetic field of the inductor forms the basis for coin identification.

Given the natural wear which occurs during a coin's circulation and the consequential range of coin interaction for a given coin denomination, a practical coin identification apparatus must accept coins which fall within certain tolerance ranges. Accuracy of measurement of the interaction of a coin and an electromagnetic field is important and particularly so for discriminating between valid coins just within the tolerance range and invalid coins just outside the tolerance range.

SUMMARY OF INVENTION

The coin testing apparatus according to the present invention comprises a coin passageway in which coins may be present, (such as a passageway through which coins pass or a coin storage tube), a resistor-inductor (RL) type relaxation oscillator circuit including an inductor adjacent the coin passageway (or inductors an opposing sides of the passageway) which produces an oscillating magnetic field in the coin passageway, means for examining the interaction between a coin in the passageway adjacent the inductor (or inductors) and the oscillating magnetic field, and means for determining whether the interaction corresponds to the interaction for an acceptable coin.

This invention provides an inductive sensor circuit which is an improvement over the inductor-capacitor (LC) type of circuit and consequently provides an improved coin testing apparatus. One aspect of the inductive sensor circuit is that it has a linear frequency response for changes of inductance within limits appropriate to coin testing. A second aspect is that the sensor circuit is easily tuned. A third aspect is that the sensor circuit will operate independently of the Q of the circuit, unlike LC oscillator circuits. Other aspects of the sensor circuit are that its output signal has well defined zero crossings and can be easily translated from logic level to logic level, e.g., TTL to CMOS.

The inductive sensor circuit according to the present invention comprises an RL relaxation oscillator operating at a frequency in the range of approximately 100 kHz to 1 MHz. The exact frequency selected depends upon the balancing of greater resolution capability versus greater adverse effects of stray capacitances at the higher frequencies. The RL relaxation oscillator is an oscillator circuit which has two stable states resulting in two distinct output levels, and which switches between the two states at a rate determined by the rate of rise or decay of voltage across the storage element in the RL circuit. The RL relaxation oscillator has a linear frequency response to changes in the effective inductance in the circuit and may be easily tuned by the adjustment of a resistor whereas typical non-relaxation type LC oscillators have a non-linear frequency response and usually require tuning by adjustment of a variable capacitor. Because the RL relaxation oscillator has nearly double the frequency shift of an LC non-relaxation oscillator per unit change in effective inductance brought about by coin influence, coin interaction with the magnetic field of the inductor of an RL oscillator can be measured with greater accuracy than the interaction of the same coin with the field of the inductor of an LC oscillator can be measured. Such improved accuracy of measurement is particularly important when a frequency of oscillation of an oscillator is sampled for a very short time.

Further features of the invention, its nature, and various advantages will be more apparent upon consideration of the attached drawings and the following detailed description of the invention.

Although coin selector apparatus constructed in accordance with the principles of this invention may be designed to identify and accept any number of coins from the coin sets of many countries, the invention will be adequately illustrated by explanation of its application to identify the U.S. 5-, 10-, and 25-cent coins. The figures are intended to be representational and are not necessarily drawn to scale. Throughout this specification the term "coin" is intended to include genuine coins, tokens, counterfeit coins, slugs, washers, and any other item which may be used by persons in an attempt to use coin-operated devices. Furthermore, from time to time in this specification, for simplicity, coin movement is described as rotational motion; however, except where otherwise indicated, translational and other types of motion also are contemplated. Similarly, although specific types of logic circuits are disclosed in connection with the embodiments described below in detail, other logic circuits can be employed to obtain equivalent results without departing from the invention.

DETAILED DESCRIPTION

Figure 1:
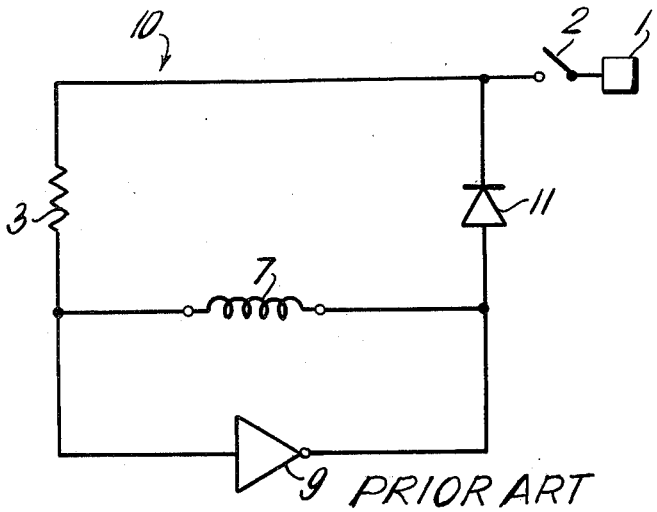
FIG. 1 illustrates a simple RL relaxation oscillator.

FIG. 1 illustrates a simple RL relaxation oscillator circuit 10 consisting of a voltage supply 1, a switch 2, a resistor 3 (R), and inductor 7 (L), a Schmitt trigger gate 9, and a diode 11. When the switch 2 is closed and voltage is initially supplied, the input to the gate 9 will be high. The gate 9 produces a low output (ground) when it receives a high input (an input above the gate's upper threshold level). The low at the output of the gate 9 provides a path for current to flow from voltage supply 1 through the resistor 3 and the inductor 7 to ground.

As the current through the inductor 7 increases, the voltage drop across the resistor 3 increases until the voltage at the input of the gate 9 drops below the gate's lower threshold level. When the input voltage level drops below the lower threshold level, the output of the gate 9 goes high interrupting the flow of current through the inductor 7. With this interruption of current, the voltage level at the output of the gate 9 rises rapidly. This rapid rise means the voltage waveform at the output of the gate 9 will have a steep slope. Diode 11 limits this rise of voltage level at the output of the gate 9 to the supply voltage plus the voltage drop across the diode 11 and provides a path for discharge of the inductor current. Inductor current discharges along a path through the diode 11 and the resistor 3 until the voltage at the input of the gate 9 again reaches the upper threshold value. When the upper threshold voltage is reached, the gate 9 again produces a low output and the cycle repeats until the switch 2 is opened. This produces an oscillation with a square waveform.

Figure 2:
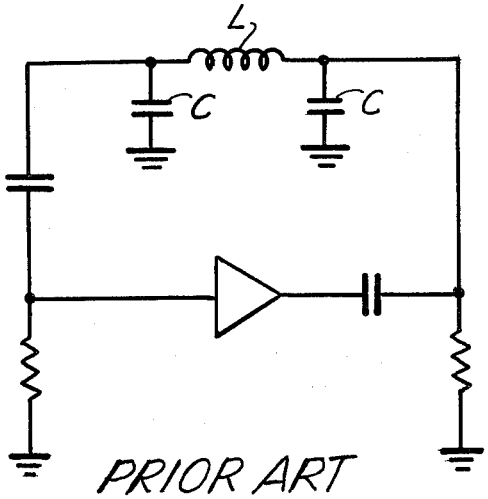
FIG. 2 illustrates a simple LC oscillator (a Colpitts oscillator) for purposes of comparison.

The frequency of oscillation of the RL oscillator 10 is approximately a constant times the ratio of R and L ($f_{RL} \cong KxR/L$). The change in frequency for a change in inductance may be approximated by the following relationship: $f_{RL} \cong f(\Delta L/L)$. For an LC oscillator such as the Colpitts oscillator of FIG. 2, containing inductor L and capacitors C of equal capacitance, the analogous relationships are $f_{LC} \cong (K/2\pi)(1/\sqrt{LC})$ and $f \cong (f)(\Delta L/2L)$.

When a coin affects the electromagnetic field of either an LC or an RL relaxation type of oscillator, it results in a change in the effective inductance in the oscillator. The RL oscillator has a linear response to changes in inductance. For a given change in effective inductance L, the change in frequency for the RL oscillator, $\Delta f_{RL}$, is twice that for the LC oscillator $\Delta f_{LC}$.

Figure 3:
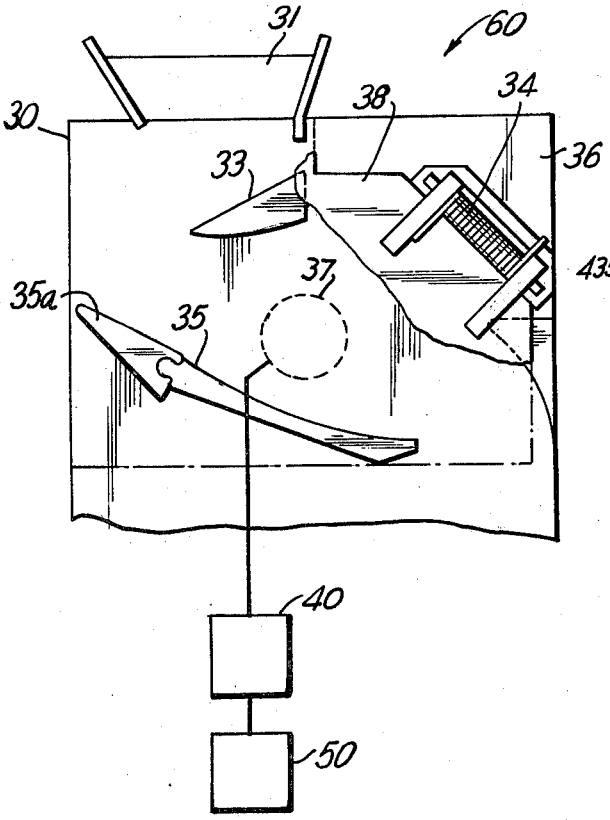
FIG. 3 is a schematic of a first embodiment of inductive coin testing apparatus according to the invention.

The present invention adapts the RL relaxation oscillator for use in coin discriminating apparatus. FIG. 3 illustrates in schematic form a first embodiment of coin discriminating apparatus 60 which comprises RL oscillator circuit 40 including inductor 37, and test means 50 to establish whether the output of oscillator 40 corresponds to that expected for an acceptable coin. The mechanical structure of the apparatus 60 may be similar to the mechanical apparatus shown and described in U.S. Pat. No. 3,870,137. The portion shown in FIG. 3 includes a back sidewall 36, a coin entry cup 31, a coin track 33 comprising an edge of a first energy dissipating device, and a second coin track 35 comprising an edge of a second energy dissipating device 35*a*, which forms the initial track section, and a terminal track section which is molded from plastic along with the sidewall 36 as a single piece. The mechanical structure of this portion of the apparatus also includes a front sidewall 38 which is spaced from and generally parallel to the back sidewall 36. The two sidewalls 36 and 38 are connected together by a hinge and spring 34 at one corner, in a manner similar to that shown in U.S. Pat. No. 3,907,086, except that the retarding apparatus disclosed in that patent is not necessarily used. Together with the energy dissipating devices 33, 35*a* and the track 35, the sidewalls 36 and 38 form a coin passageway from the coin entry cup 31 past the coin testing inductor 37 which is located in or behind one of the sidewalls. The inductor's location with respect to the coin track is generally indicated by broken lines in FIG. 3.

The test means 50 used with this embodiment is circuitry which measures the maximum shift in frequency of the oscillator circuit 40 from normal idling frequency and determines whether this frequency shift corresponds to that produced when a genuine coin passes the inductive element in the RL oscillator circuit. Circuitry for measuring the frequency shift is shown and described, for example, in U.S. Pat. Nos. 4,336,297 and 3,918,564. See particularly FIG. 5 and the corresponding discussion in U.S. Pat. No. 4,361,218; and FIG. 4 and text at column 3, line 60 to column 4, line 55 in U.S. Pat. No. 3,918,564. Alternatively, the test means 50 can be any one of a number of suitable detector circuits which detect whether the maximum frequency of the oscillator during coin passage is within a tolerance range of the frequency for a genuine coin. See, for example, FIGS. 4, 10 and 8 and the corresponding text at column 5, line 13 et seq.; column 10, line 65 to column 11, line 47; and column 21, line 66 to column, 23, line 47 in U.S. Pat. No. 3,870,137.

A coin enters the mechanical section 30 of apparatus 60 through coin entry 31. The coin then travels along coin tracks 33 and 35 between sidewalls 36 and 38. Sidewalls 36 and 38 are parallel plates spaced apart by at least slightly more than the thickness of the thickest coin to be processed by the apparatus. In addition, sidewalls 36 and 38 are tilted slightly from the vertical so that a face of a coin rolling down coin track 33 and later coin track 35 bears on front sidewall 38. Inductor 37, as shown in FIG. 3, is mounted alongside coin track 35 in the front sidewall 38. Alternatively, the inductor 37 may consist of two coils series connected opposite each other, one coil being mounted in each sidewall. A two coil embodiment will be discussed in conjunction with FIGS. 4 and 6.

Figure 5:
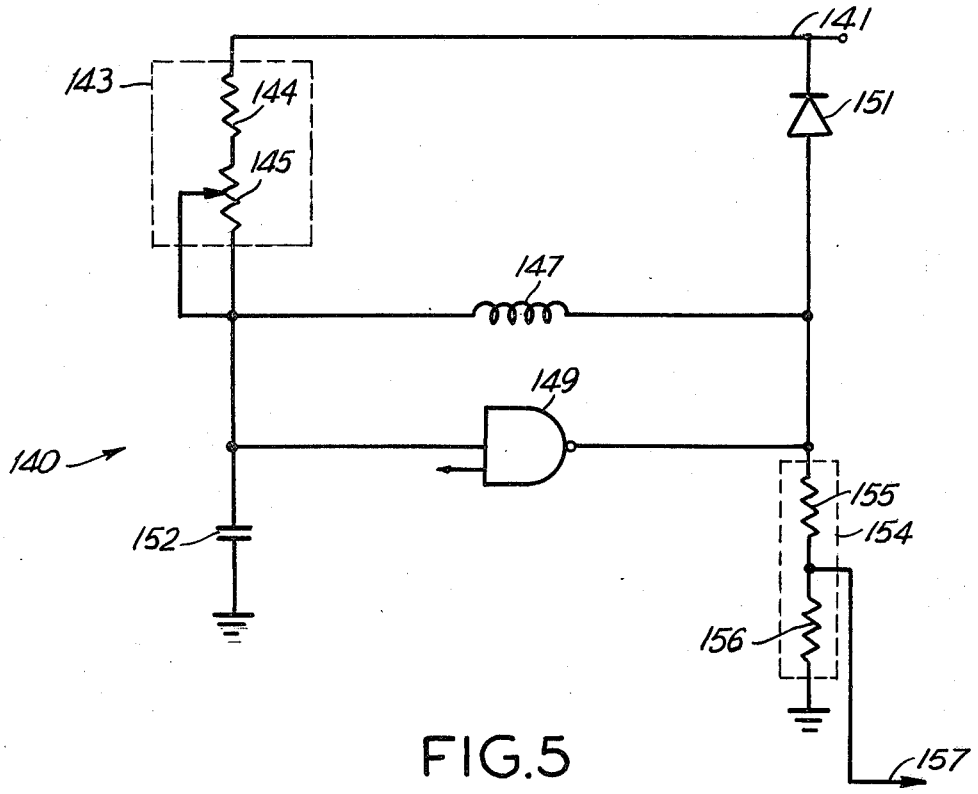
FIG. 5 illustrates an oscillator circuit suitable for use in determining a coin characteristic such as coin diameter in any of the disclosed embodiments of the invention.
Figure 6:
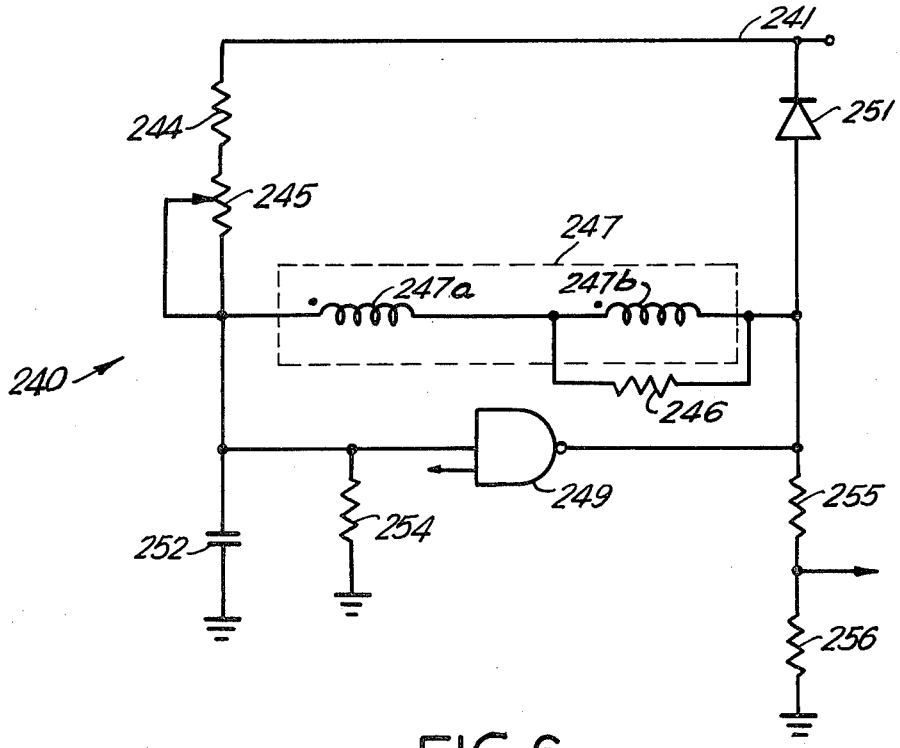
FIG. 6 illustrates a second oscillator circuit suitable for use in determining a coin characteristic such as coin thickness in any of the disclosed embodiments of the invention.

Inductor 37 is part of the RL relaxation oscillator circuit 40 such as the oscillator circuits shown in FIG. 5 and FIG. 6. When a coin passes inductor 37, the frequency of oscillation of oscillator circuit 40 will shift. Test means 50 of FIG. 3 determines in known fashion if the peak frequency shift of the oscillator circuit 40 during coin passage is indicative of an acceptable coin, i.e., whether the maximum frequency or frequency shift occurring during coin passage is within a predetermined tolerance range.

Figure 4:
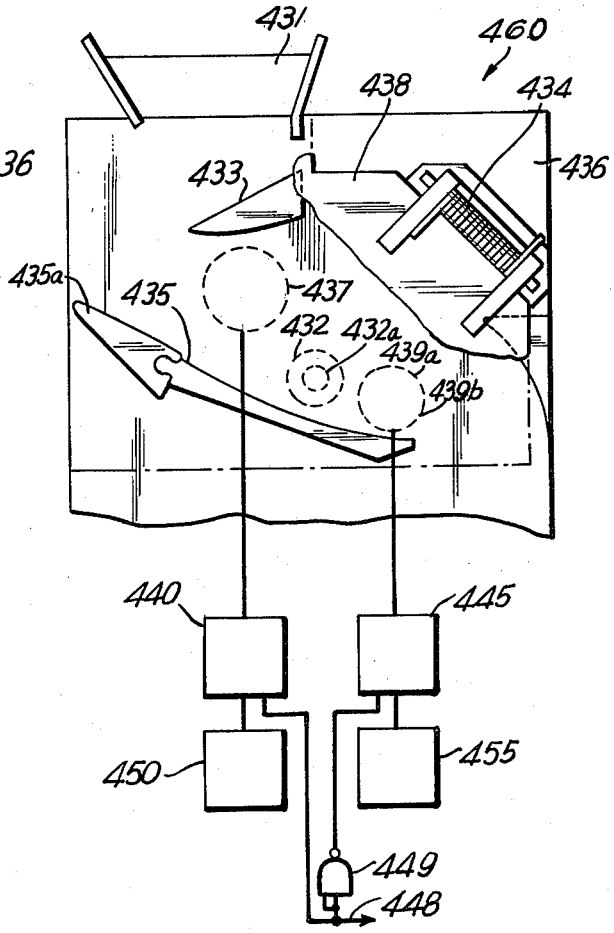
FIG. 4 is a schematic of second and third embodiments of inductive coin testing apparatus according to the invention.

In second and third embodiments shown in FIG. 4, two oscillator circuits such as those shown in FIGS. 5 and 6 are combined in a single apparatus 460 for testing two characteristics of a coin. (A low frequency inductive coin examining circuit, such as that disclosed in the co-pending application entitled "Low Frequency Phase Shift Coin Examination Method and Apparatus", now U.S. Pat. No. 4,398,626 and assigned to the assignee of this application, can be advantageously incorporated in the same apparatus for more complete testing of coin characteristics. The locations of inductors as disclosed in an embodiment of that application are indicated by the broken lines 432 and 432*a* of the present application.)

A coin to be tested enters the mechanical portion of the apparatus 460 through coin entry 431. The coin then travels along coin tracks 433 and 435 between the back sidewall 436 and the front sidewall 438. The coin first reaches inductor 437 which is mounted in the front sidewall 438. The inductor 437 is of the pot core type, approximately 21.6 mm in diameter with its face approximately 0.4 mm from the passageway side of the front sidewall 438 and its center approximately 20 mm above the coin track in an embodiment for the United States coin set. Inductor 437 is part of oscillator circuit 440. Coin passage by inductor 437 will affect the frequency of oscillation of oscillator 440. Test means 450 is connected to oscillator 440 and determines if this effect is indicative of an acceptable coin. An idling frequency, the frequency of oscillation when a coin is not passing by inductor 437, of about 300 kHz for oscillator 440 is employed for coin diameter testing in this embodiment.

After passing inductor 437, the coin continues along coin track 435 toward inductors 439*a* and 439*b*. These two inductors are connected in series and are mounted opposite one another in the sidewalls. Each of inductors 439*a* and 439*b* is of the pot core type, approximately 18 mm in diameter with its face approximately 0.4 mm for the passageway side of the sidewall in which it is mounted and its center approximately 9.5 mm above the coin track in an embodiment for the United States coin set. Inductors 439*a* and 439*b* are part of oscillator 445 which, like oscillator 440, is affected by coin passage. Test means 455 is connected to oscillator 445 and determines if this effect is indicative of an acceptable coin. An idling frequency of about 850 kHz for oscillator 445 is employed for coin thickness testing in this embodiment. A signal on line 448 is employed to switch on either of the oscillators 440 and 445. An inverter 449, shown in FIG. 4 as an inverter connected NAND gate, is connected between line 448 and one of the oscillators, so that when oscillator 445 is on, oscillator 440 is off and vise versa, thus avoiding the possibility of interference between them.

FIG. 5 illustrates an RL relaxation oscillator 140 suitable for use in coin discrimination apparatus according to either of the embodiments of my invention. The basic functioning of oscillator 140 is similar to that of the oscillator 10 of FIG. 1. Resistor 143 corresponding to resistor 3 of FIG. 1, consists of fixed value resistor 144 and adjustable resistor 145. The addition of the adjustable resistor 145 allows the frequency of oscillator 140 to be tuned by simply adjusting the adjustable resistor 145. Capacitor 152 connected between one input of a NAND gate Schmitt trigger 149 and ground is added to eliminate higher modes of oscillation resulting from stray capacitance in the circuit. The other input to the NAND gate 149 is a control line for switching the oscillator 140 on or off. Additional resistors 155 and 156 connected in series between the output of gate 149 and ground serve as an output attenuator 154 to reduce the amplitude of the signal produced at the output of gate 149 to a level compatible with the circuitry of the test means used to determine if the coin effect on the oscillator 140 is indicative of an acceptable coin.

An output signal suitably scaled by the output attenuator 154, is taken from the node connecting resistors 155 and 156 using line 157. The output signal on line 157 is digital in nature and requires no amplitude adjustment or shaping beyond that provided by attenuator 154 to be suitable for counting. The digital nature of the signal on line 157 makes the RL relaxation oscillator 140 especially suitable for use in coin discrimination apparatus employing a microprocessor or other digital circuitry.

A circuit similar in construction to the one shown in FIG. 5 is suitable for use in determining coin diameter. For diameter testing according to one embodiment of the invention, inductor 147 consists of a single coil with an inductance of 1.0 mH and the idling frequency of oscillator 140 is about 300 kHz. Table 1 below lists typical values of components for an oscillator circuit as shown in FIG. 5.

TABLE 1

| | | |
|---|---|---|
| Supply | 141 | 5V DC |
| Resistors | 144 | 330 Ohms |
| | 155 | 1 k |
| | 156 | 5.1 k |
| Adjustable Resistor | 145 | 0–1 k |
| Inductor | 147 | 1 mH |
| Schmitt Trigger | 149 | One section of a National Semiconductor Model No. DM 74132 four section Schmitt trigger NAND gate |
| Diode | 151 | 1N4004 |
| Capacitor | 152 | 180 pf |

A circuit similar in construction to the one shown in FIG. 6 can be used for determining coin thickness. The basic functioning of oscillator 240 is similar to that of oscillator 10 in FIG. 1 and oscillator 140 of FIG. 5. For coin thickness testing, inductor 247 consists of two coils 247*a* and 247*b* connected in series. In this embodiment, each of the coils has an inductance of 240 uH and the idling frequency of oscillator 240 is about 850 kHz. Since the coils 247*a* and 247*b* of the inductor 247 are on opposite sidewalls of the apparatus, the leads are relatively long. A resistor 246 is provided to reduce the adverse capacitative effects of these leads. A resistor 254 is provided to reduce drift of frequency shift with temperature. Table 2 below lists typical values of components for an oscillator circuit as shown in FIG. 6.

TABLE 2

| | | |
|---|---|---|
| Supply | 241 | 5V DC |
| Resistors | 244 | 330 Ohms |
| | 246 | 43 k |
| | 254 | 2.2 k |
| | 255 | 1 k |
| | 256 | 5.1 k |
| Adjustable Resistor | 245 | 0–1 k |
| Inductor | 247 | 2 coils - each 240 uH |
| Schmitt Trigger | 249 | One section of a National Semiconductor Model No. DM 74132 four section Schmitt trigger NAND gate |
| Diode | 251 | 1N4004 |
| Capacitor | 252 | 82 pF |

I claim:

1. A coin testing apparatus comprising means to subject a coin to an electromagnetic field and to produce a digital signal indicative of the degree of interaction of the coin with the field, and means to determine whether said signal corresponds to that for an acceptable coin, wherein said means to subject a coin to an electromagnetic field and to produce a digital signal comprises a coin passageway and a resistor-inductor type relaxation oscillator having an oscillation frequency determining inductor adjacent the coin passageway, the inductor producing the electromagnetic field in the coin passageway, said resistor-inductor relaxation oscillator having a substantially linear frequency change with respect to change in the effective inductance in the oscillator over a range of inductance suitable for testing coins and producing an output signal which is digital in nature and requires no amplitude discrimination or shaping to be suitable for counting, and said means to determine whether said signal corresponds to that for an acceptable coin comprises counting means for counting the digital output signal.

2. The apparatus of claim 1, wherein the resistor-inductor relaxation oscillator further comprises a variable resistor connected to the inductor.

3. The apparatus of claim 1, wherein the resistor-inductor relaxation oscillator further comprises a capacitor connected to eliminate higher modes of oscillation due to stray capacitance in the resistor-inductor relaxation oscillator.

4. The apparatus of claim 1, wherein the inductor comprises a single coil and the normal frequency of oscillation of the oscillator in the absence of a coin is approximately 300 kHz.

5. The apparatus of claim 1, wherein the coin passageway has two sidewalls, the inductor comprises two coils which are serially connected, the coils being mounted opposite one another on the sidewalls of the coin passageway and the normal frequency of oscillation of the resistor-inductor relaxation oscillator in the absence of a coin is approximately 850 kHz.

6. The apparatus of claim 1, wherein the means to produce a signal indicative of the degree of interaction of the coin with the electromagnetic field comprises means responsive to the frequency of the resistor-inductor relaxation oscillator when the coin passes and means to produce a signal indicative of the frequency of the oscillator.

7. A coin testing apparatus comprising a coin passageway, first means to subject a coin to a first electromagnetic field and to produce a first signal indicative of the degree of interaction of the coin with the first field, second means for subjecting the coin to a second electromagnetic field and to produce a second signal indicative of the degree of interaction of the coin with the second field, and means to determine if the first and second signals correspond to those for an acceptable coin, wherein each of said first and second means to subject the coin to first and second electromagnetic fields and to produce first and second signals comprises a resistor-inductor type relaxation oscillator having an oscillation frequency determining inductor adjacent the coin passageway, each resistor-inductor relaxation oscillator having a linear frequency response with respect to changes in the effective inductance in the oscillator over a range of inductance suitable for testing coins and producing an output signal which is digital in nature and requires no amplitude discrimination or shaping to be suitable for counting.

8. The apparatus of claim 7, wherein each resistor-inductor relaxation oscillator further comprises a variable resistor connected to the inductor.

9. The apparatus of claim 7, wherein each resistor-inductor relaxation oscillator further comprises a capacitor connected to eliminate higher modes of oscillation due to stray capacitance in the resistor-inductor relaxation oscillator.

* * * * *

UNITED STATES PATENT AND TRADEMARK OFFICE

CERTIFICATE OF CORRECTION

PATENT NO. : 4,416,365

DATED : November 22, 1983

INVENTOR(S) : Frederic P. Heiman

It is certified that error appears in the above—identified patent and that said Letters Patent is hereby corrected as shown below:

Col. 3, line 46 "$f_{RL} \cong f(\Delta L/L)$" should be

--$\Delta f_{RL} \cong -f(\Delta L/L)$--.

Col. 3, line 49 "$f \cong (f)(\Delta L/2L)$" should be

--$\Delta f_{LC} \cong -f(\Delta L/2L)$--.

Col. 4, line 26 "4,336,297" should be --4,361,218--.

Col. 5, line 48 "vise" should be --vice--.

Signed and Sealed this

*Tenth* Day of *December 1985*

[SEAL]

*Attest:*

DONALD J. QUIGG

*Attesting Officer*

*Commissioner of Patents and Trademarks*